US005357950A

United States Patent [19]

Wippler et al.

[11] Patent Number: 5,357,950

[45] Date of Patent: Oct. 25, 1994

[54] BREATH ACTUATED POSITIVE PRESSURE DEMAND REGULATOR WITH OVERRIDE

[75] Inventors: John Wippler, Downey; Max L. Kranz, La Habra, both of Calif.

[73] Assignee: Comasec International S.A., Paris, France

[21] Appl. No.: 25,111

[22] Filed: Mar. 2, 1993

[51] Int. Cl.[5] ..... A62B 7/04

[52] U.S. Cl. ..... 128/205.24; 128/204.26; 137/495; 137/908; 251/74

[58] Field of Search ..... 128/205.24, 204.18, 128/204.26, 207.12; 137/908, 495; 251/74, 82; 124/65, 66, 16; 606/182; 42/1.13, 54

[56] References Cited

U.S. PATENT DOCUMENTS

| | | | |
|---|---|---|---|
| 3,915,164 | 10/1975 | Bird . | |
| 4,361,145 | 11/1982 | Ekstrom | 128/204.26 |
| 4,494,537 | 1/1985 | Gottlieb | 128/204.26 |
| 4,503,852 | 3/1985 | Christianson | 128/204.26 |
| 4,715,371 | 12/1987 | Haas | 128/204.26 |
| 5,152,775 | 10/1992 | Ruppert | 606/182 |
| 5,203,872 | 4/1993 | Naffziger | 251/82 |

FOREIGN PATENT DOCUMENTS 0260021 8/1987 European Pat. Off. .

*Primary Examiner*—Edgar S. Burr
*Assistant Examiner*—Eric P. Raciti
*Attorney, Agent, or Firm*—George F. Bethel; Patience K. Bethel

[57] ABSTRACT

A positive pressure demand regulator having a housing with a connection for delivering breathing gas with an outlet connected to the housing for attachment to a mask. A diaphragm is mounted in the housing and a passage connects the outlet and the diaphragm so that the diaphragm can be in fluidically connected relationship to the outlet. A main valve interconnects the breathing gas connection to the outlet for valving breathing gas to the outlet. A cam is attached to the diaphragm for lifting the diaphragm into an inoperative mode with a detent connected to the cam operated by a cam rod engaging a cam surface to lift the detent into a position for placing the detent in displaced relationship from where the diaphragm is in an operative mode, mounted in the housing on the side of the diaphragm opposite from the outlet.

23 Claims, 5 Drawing Sheets

BREATH ACTUATED POSITIVE PRESSURE DEMAND REGULATOR WITH OVERRIDE

FIELD OF THE INVENTION

The field of this invention lies within the art of breathing gas regulation. Breathing gas regulation can be effectuated by a high pressure first stage regulator, and a second stage or positive pressure demand regulator. This invention is directed toward the second stage or positive pressure demand regulator. The regulator can be of the type provided with a bypass valve, a pilot valve, and an override that can be actuated with a users first inhalation.

BACKGROUND OF THE INVENTION

Breathing gas regulators of the second stage or the positive pressure demand type regulators are used by underwater divers as well as firemen and industrial workers. The breathing gas regulators allow for demand regulation when one inhales.

Such second stage positive pressure demand type regulators are generally connected to a source of breathing gas. The source of breathing gas can be a first stage regulator or high pressure regulator. The first stage or high pressure regulator is generally connected by a valve to a tank of highly pressurized breathing gas. The first stage demand regulator or high pressure regulator regulates the high pressure in the tank down to a pressure within the range of 150 pounds per square inch (psi). This lowered pressure of 150 psi is in connected relationship to a hose or other conduit that is then connected to the second stage or positive pressure demand regulator.

The second stage or positive pressure demand regulator has a mouthpiece or means to connect the regulator to a mask for breathing purposes. When inhalation takes place by one attempting to breathe, the second stage or positive pressure demand regulator actuates a valve to provide for the flow of breathing gas from the first stage regulator through the second stage for breathing purposes. This has been accomplished in the past by a diaphragm system.

The diaphragm generally moves upon inhalation, thereby tripping a valve mechanism such as a tilt valve or other type of lever in order to provide for valving the breathing gas. When the inhalation by a user is encountered, the diaphragm is displaced so as to cause the valve connected to it to open. This creates an upstream valve function by the first stage regulator to allow for the flow of gas on a demand basis.

When such regulators are used by firemen, industrial or safety workers, it is desirable to have a positive pressure to prevent the inflow of noxious gases. This is accomplished by either a free flow into a users mask or regulator, or in the alternative a positive pressure that is established.

In order to prevent inordinate amounts of air flow, a means for shutting off the regulator has been utilized in the past which can be actuated by inhalation. This invention specifically relates to such inhalation actuation as well as the specific pilot valve and valving functions hereof.

This invention is directly related to the concept of providing for a second stage regulator shut off override. The regulator can then be re-actuated by an initial first breath or inhalation to put the regulator back into a gas regulating function. The invention is specifically enhanced by virtue of a slide device which lifts a coupler attached to the diaphragm so as to place the diaphragm in an inoperative overridden or shut off mode. This slide device relies upon a spring biased coupler which can re-actuate the regulator by a negative pressure or inhalation against the diaphragm. This then allows the unique pilot and valving function of this invention to proceed with providing uniform and consistent action of the second stage regulator upon continued inhalation and breathing functions.

The regulator is also enhanced by a bypass valve and a particularly unique design for allowing the bypass valve to function independent of the main valve. The main valve is formed of an elastomeric balanced valve member on a valve seat. It is pilot valve operated by a levered toggle mechanism that allows the pilot valve to cause the main valve to function upon inhalation being encountered at the face of the diaphragm.

The inter relationship of the bypass valve, reactuating the override function, the pilot valve, and the main valve along with other features hereof make this a unique and different regulator over the prior art, as will be seen in the specification hereinafter.

SUMMARY OF THE INVENTION

In summation, this invention comprises a novel second stage or positive pressure demand regulator having a pilot operated main valve with a diaphragm for operating the pilot valve and features a slide operated override to prevent second stage or pressure demand regulator functions, until inhalation or a switch mechanism re-actuates the regulator into an operative mode. The override elements or first breath on mechanism are contained in the housing opposite from the pressure sensing chamber separated by the diaphragm.

More particularly, the invention comprises a valve body. The valve body contains a valve seat therein. Adjacent the valve seat is a main valve in the form of an elastomeric valving member that flexes to allow the passage of gas to a user.

The main valve is actuated by means of a pilot valve. The pilot valve has a lever with a valve surface overlying a valve seat. The lever is biased by means of a spring which causes one end thereof to be placed in proximate relationship to a diaphragm which is exposed to the pressure sensing chamber.

The diaphragm on the other side of the pressure sensing chamber has a coil spring biasing it against the beam or pilot valve lever. The diaphragm is connected to a coupling assembly. The coupling assembly is in turn inter related to a slide actuated lift off device, cam, activator, or coupler. The lift off device incorporates an inclined plane or cam surface for lifting the coupler or activator with the diaphragm into an inoperative or override mode. After the coupler has been lifted, it is held in a spring biased relationship by a detent mechanism.

The coupler is provided with a button means for pushing the coupler in a manner to release the detent means. This will place the regulator into an operative mode.

A further feature is the utilization of an adjustment screw which adjusts the pressure setting of the regulator. There is also an adjustment nut that adjusts the position of the coupler or activator.

More importantly, the regulator can be connected to a user and inhalation can take place whereby the diaphragm is re-actuated, by drawing it inwardly. Upon drawing inwardly, the detent of the coupler is overridden to allow the diaphragm to function thereafter in an operative mode with the pilot valve and the main valve operating in response to the pilot valve. All of the foregoing operative elements are located on the opposite side of the diaphragm from the pressure sensing chamber.

As will be appreciated, this invention is a significant step over the prior art as enunciated hereinafter in the specification and as claimed.

DESCRIPTION OF THE PREFERRED EMBODIMENTS

Figure 1:
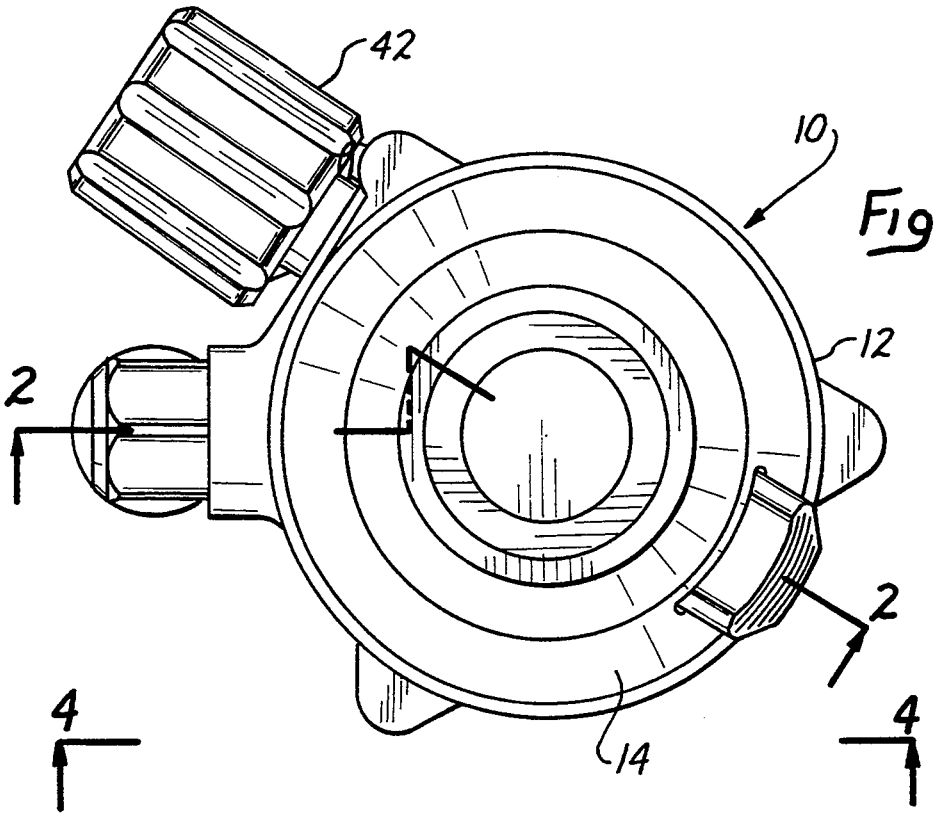
FIG. 1 shows a plan view of the demand or second stage regulator of this invention looking downwardly on the top of the regulator.

Looking at the Figures in conjunction with each other, it can be seen that FIG. 1 shows the positive pressure demand regulator 10 of this invention. The positive pressure demand regulator (regulator or demand regulator) 10 has an assembly housing or body 12. The assembly housing or body 12 incorporates an assembly cover 14. The assembly cover 14 is such wherein it overlies the body 12 to encapsulate in part the operative elements of this invention as well as provide for a portion of the entire housing.

The regulator 10 is generally connected to a breathing gas mask or oral/nasal mask portion of an assembly. This is effected by means of a connecting, outlet conduit or connector tube 16.

In order to connect the connector tube 16 to a mask or oral/nasal mask assembly, the connector tube or outlet conduit 16 is locked thereto by means of spring loaded detent catches 18 having latch surfaces 20. The detent catches 18 are operated by push buttons 22.

Figure 4:
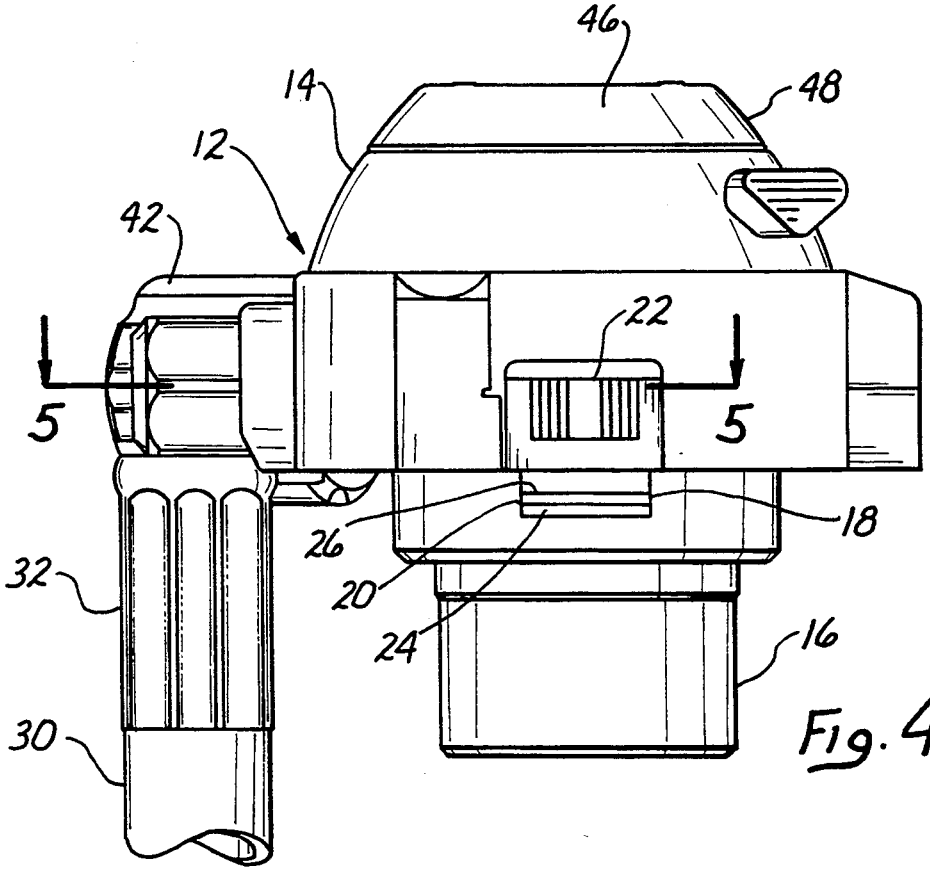
FIG. 4 shows a side elevation view of the regulator of FIG. 1 in the direction of lines 4—4 of FIG. 1.

The push buttons 22 push the detents 18 radially inwardly away from the view as seen in FIG. 4 toward the back of the drawing. This causes the detent latch surfaces 20 to disengage or engage an overlying shelf, flange or connecting surface on a mask or oral/nasal cover. The detent 18 has a downwardly sloping surface 24 which can be used to override the bias spring of the detent button and allow it to engage on a top surface 26 of the detent 18. In order to cause the detent 18 to move, the entire assembly with the push buttons 22 are movable by means of overcoming a spring which loads the detent 18 and the push button 22.

Figure 2:
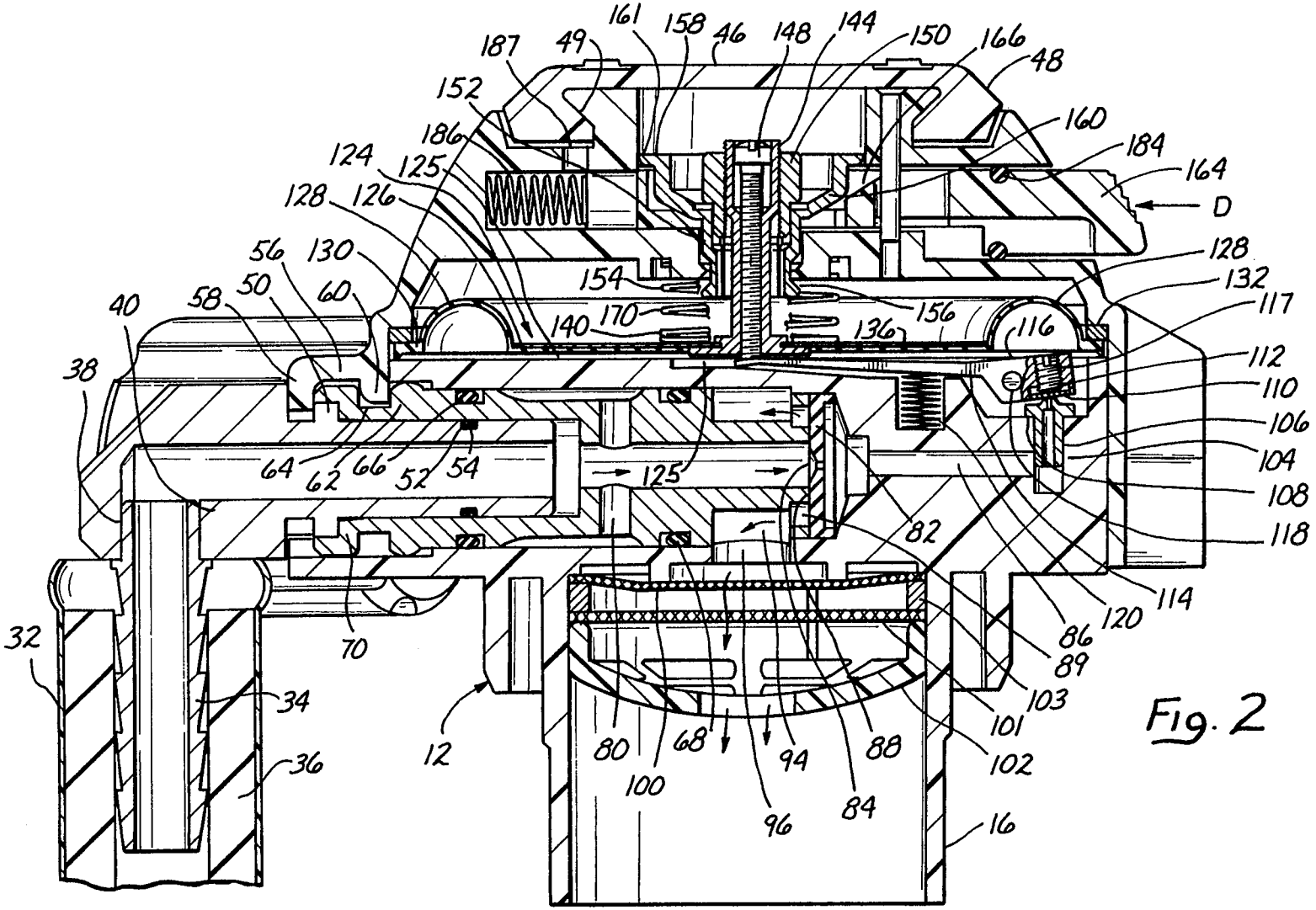
FIG. 2 shows a sectional view of the regulator along lines 2—2 of FIG. 1.

The assembly housing or body 12 receives a source of regulated air from a first stage or high pressure regulator through a hose 30. The hose 30 is connected to the assembly housing 12 by an L shaped fitting 41. A metal sleeve 32 engages the hose 30 tightly to squeeze it against a barbed fitting that can be more easily seen in FIG. 2. The barbed fitting comprises a barbed extension 34 which receives the hose 30 thereon which is engaged and squeezed by the metal sleeve 32 into tightened engagement therewith.

The entire barbed fitting 34 is brazed or threaded at its interface 38 to provide for a brazed or threaded connection to a connector tube, conduit, or pipe 40. The connector tube 40 along with the entire brazed or threaded assembly of the barbed portion or fitting 34 and connector tube 40 comprise an L shaped fitting or member 41 which extends into the assembly housing 12.

In order to maintain the assembly cover 14 attached to the entire assembly housing 12, screws are utilized to retain the two portions together.

The assembly housing 12 incorporates a bypass valve with a handle or twist knob, namely handle 42. The handle 42 is in effect a knob that can be turned in order to provide for a bypass function.

In order to allow for a purge or reactivation of the regulator, an elastomeric manual override button 46 is incorporated. The manual override button 46 comprises an elastomeric button member having a sloping shoulder 48 which engages an undercut 49 of the assembly cover 14. This can be readily seen in FIGS. 2 and 3. The manual override button 46 can be used to operate the regulator 10 with a purge function or cause the override assembly which overrides the operation of the diaphragm described hereinafter to be released.

Looking again more particularly at the supply of breathing gas to the regulator 10, it can be seen that the brazed or threaded barbed portion 34 provides for the L shaped member comprising in part the connector tube 40. The tube 40 is formed and brazed with the barbed portion 34 to form the L shaped member 41. The L shaped member 41 has a connector flange 50 and an O-ring 52 seated in a groove 54. The L shaped member 41 can thus be seated in the assembly housing 12.

Seating of the L shaped member 41 is accomplished by the cover assembly 14 having a flanged groove 56. The flanged groove 56 has flanges 58 and 60 on either side thereof which serve to receive the L shaped member 41 with the flange portion 58. The other flange portion 60 helps to secure an assembly valve seat member 62. The assembly valve seat member 62 provides for the valve seat as will be described hereinafter and other related functions.

The valve seat member 62 can be made of a plastic material or a machined metal fitting which is inserted into the assembly housing 12. The seat member 62 is utilized for the seating of the valve as will be enunciated hereinafter. The seat 62 has a groove 64 which is captured by the flange 60. In order to seal it within the housing, O rings 66 and 68 are utilized by seating them in grooves of the assembly seat 62.

The assembly seat or valve seat assembly member 62 is such wherein it receives the L shaped hose connector 41 against an interior shoulder 70.

In order to provide for a bypass function to supplement the regulator function, a pair of holes or bypass orifices 80 are provided in the seat assembly 62. This allows air to bypass and flow through a conduit when the bypass knob 42 is turned as will be seen in the figure description of FIG. 5 enunciating the bypass functions.

The assembly seat 62 seats against an elastomeric member, disc, cover or valve 82 that provides the main valve. The elastomeric member or valve 82 has an orifice 84. The orifice 84 allows for the flow of gas to the downstream side of the valve 82. When the pressure is imbalanced by the pilot valve of this invention imbalancing it with pilot valve flow through a conduit 86 to which the pilot valve is connected, the main valve 82 will unseat from its seat surfaces 88. This allows for the flow in the direction of the arrows indicated. In effect, the main valve 82 lifts off the seat assembly 62 seat surfaces 88 so that the flow around them moves through a plurality of passages 89 toward the user as seen in the direction of the flow arrows.

The flow is through a surrounding or circumferential groove 94 of the seat assembly 62 and through the passage 96 outwardly of the regulator. The regulator has screens 100 and 101 separated by spacer 103 at the outlet conduit 16. To hold the screen and spacer in place, a baffle 102 is implaced having openings in the form of a grid work which allows for the passage of air outwardly through the conduit or connector 16. The screens and baffle function as a flow diffuser to provide a stable feedback pressure to the diaphragm assembly 124.

The valve 82 functions through the pilot mechanism which allows the valve 82 to lift off from surfaces 88. A pilot valve seat 104 is pressed into the housing 12 within an opening 106 connected to the passage 86. The pilot valve seat 104 has a narrowed orifice 108 with a reduced or conical valving surface at the end thereof. Orifice 108 has a larger orifice cross section than the main valve 82, namely the main valve's orifice 84.

The pilot valve seat 104 is pressed fit into the opening 106 and has an overlying adjustable valve 112. The pilot seal 110 is molded into pilot valve 112 to provide the valve over the orifice 108. The valve 112 allows for adjustment through the top of a lever 114 on a pivot point provided by a pin 116 within a hole 117 of the lever 114.

In order to balance the valve 112 on the orifice 108 and drive it against the orifice until it is displaced by an action to be described hereinafter, a coil spring 120 is utilized to impress itself on an expanding basis against the lever 114. The coil spring 120 is seated within an opening within the housing 12. This biases the lever 114 at the spring contact point for movement upwardly. This covers and uncovers the orifice 108 when the seal 110 attached to the valve 112 is displaced therefrom.

All of the foregoing elements are on the pressure sensing chamber side of the housing 12. They are divided from the override section by a diaphragm.

In contact with the lever 114 is a diaphragm assembly 124. The diaphragm assembly 124 comprises an elastomeric diaphragm member 126 supported by disc 136 having a rounded annular convoluted portion 128 surrounding the periphery thereof and terminating with a flange portion 130. The flange portion 130 is supported by a ring 132. This tends to secure the diaphragm into tight juxtaposition within the housing 12 and in particular the lid or cover 14. The override portions are within the lid or cover 14 portion of the housing on the opposite side of the diaphragm assembly 124.

Figure 3:
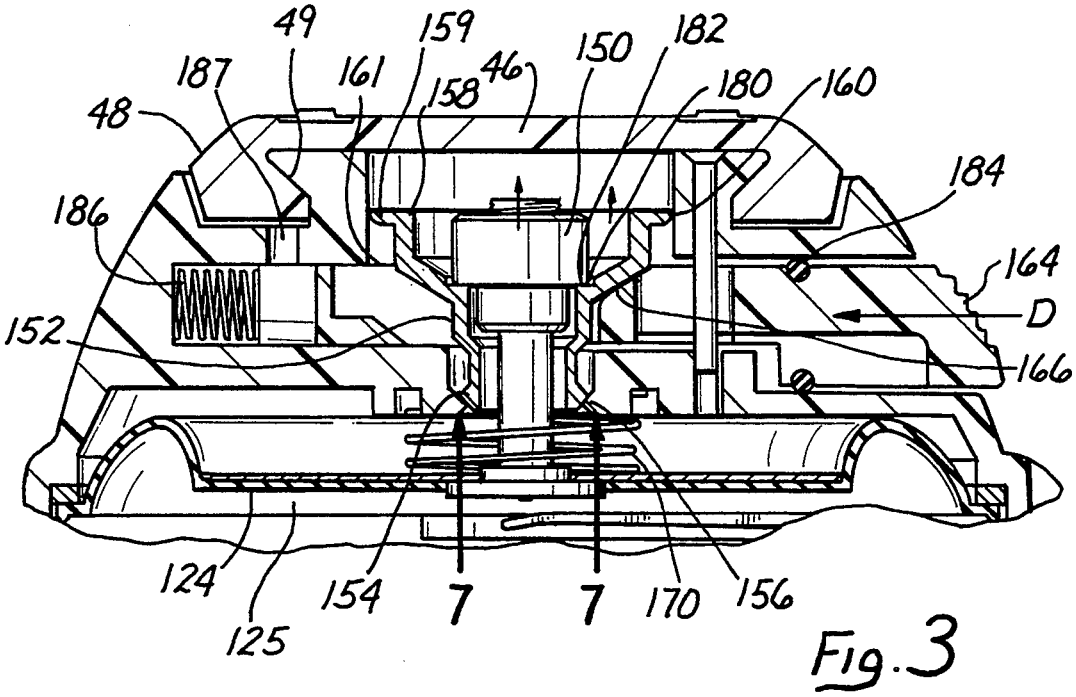
FIG. 3 shows a partial sectional view of the regulator similar to that of FIG. 2 but wherein the diaphragm has been overridden by the operative action of the movement of this invention to place it in an inoperative mode, until breathing is again required.
Figure 6:
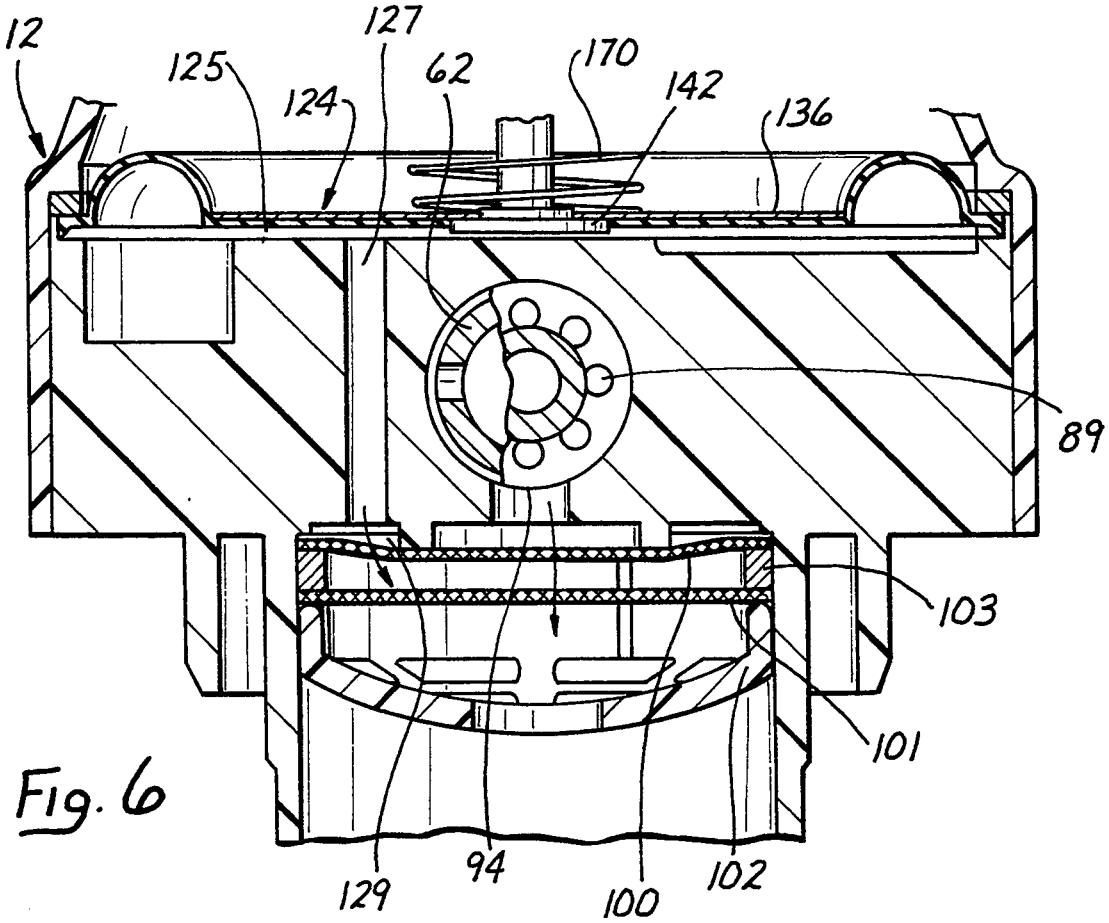
FIG. 6 shows a sectional view as seen in the direction of lines 6—6 of FIG. 5.

In order to fluidically connect the diaphragm 124 to the exit conduit 16 which is connected for inhalation purposes to a user and to cause said diaphragm 124 to move in response to inhalation under demand, an area 125 within the pressure chamber underlying said diaphragm can be seen in FIGS. 3 and 6. This area 125 underlying the diaphragm is connected to a passage 127 which is in turn connected to an opening 129.

As can be seen passage 127 is in direct communication with the exit conduit 16 so that variances in pressure as seen in the area 125 below the diaphragm can be sensed at the exit conduit 16 to cause the diaphragm 124 to function. The variances in pressure of course are due to the breathing action which changes the pressure in the conduit 16 with respect to the preset pressure. This area in the housing 12 on the pressurized side of the diaphragm is generally referred to as the sensing chamber.

Bonded to the diaphragm elastomeric material 126 is a support plate 136. The support plate is secured to an inset groove of an inverted T member or post 140. The inverted T member or post 140 has an enlarged head 142 detailed in FIG. 6 which receives the support plate 136.

The inverted T member or post extends upwardly and terminates in an exteriorly threaded portion 144. The inverted T member 140 receives a screw 148 therein having a slotted head that provides the adjustment of the static pressure of the regulator. This is caused by the change of spring force on the diaphragm assembly. Nut 150 is threaded onto the exteriorly threaded screw portion 144 of the inverted T member 140. The nut 150 secures a spring like detent member, activator, or lift off device 152 and provides position adjustment of the detent.

The action of the screw 148 against the spring force of the spring 170 against the diaphragm changes the reference force on the diaphragm and consequently the static set pressure of the regulator. Nut 150 changes the spacing with respect to the ledge 180 of the detent member 152 which engages shoulder 182 of the nut provides for position adjustment of the override of the regulator.

Figure 7:
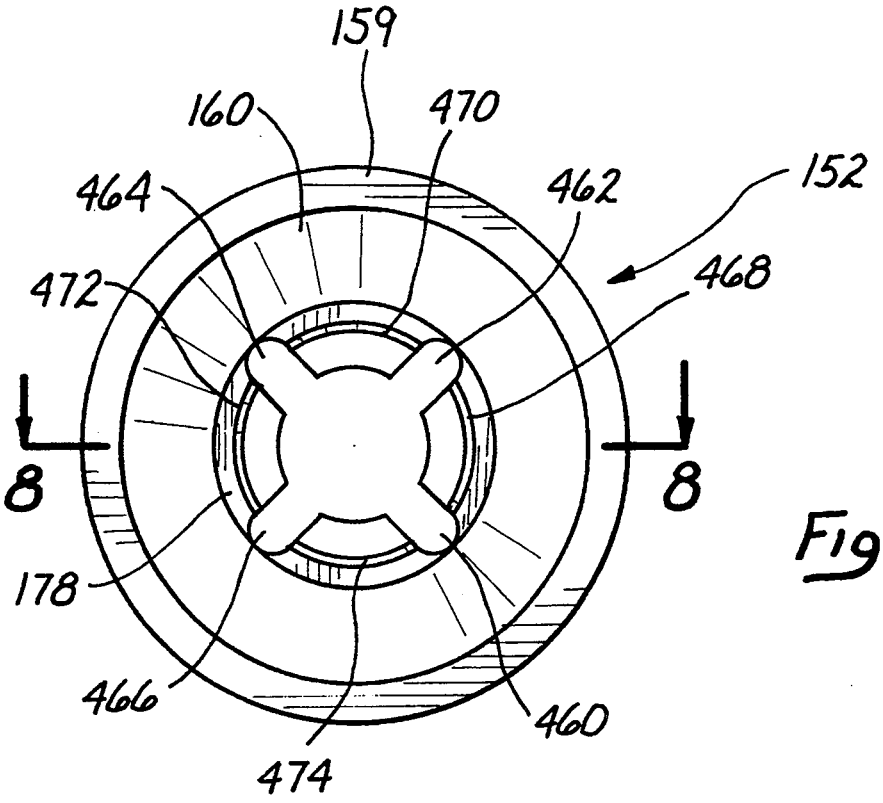
FIG. 7 shows a view of the coupler or activator looking upwardly in the direction of lines 7—7 of FIG. 3.
Figure 8:
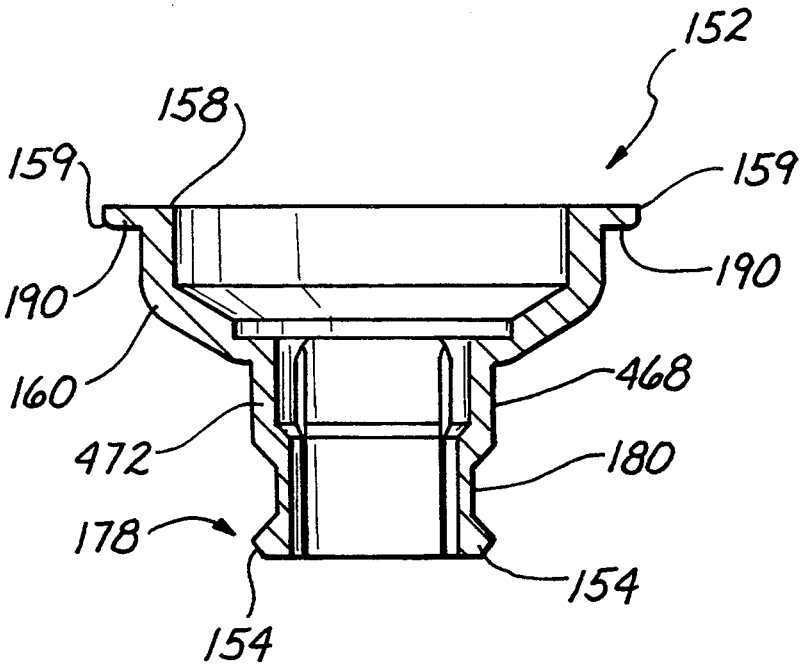
FIG. 8 shows a sectional view of the coupler or activator in the direction of lines 8—8 of FIG. 7.

The spring like detent member 152 is a plastic circular member seen in FIGS. 7 and 8 which is partially split with slits 460, 462, 464, and 466 in an axial direction into four quadrants 468, 470, 472, and 474 so that it can be contracted and expanded by flexure through its cross section. In effect the detent action is through the expansion and contraction along the four quadrant slits 460 through 466. The spring like detent member 152 has a lower portion with detents or prongs 154 that override a ledge circular flange or protuberance 156 when displaced into the assembly cover. These prongs 154 are formed as an angular flange 178 divided by the respective slits 460 through 466. They extend outwardly from a groove 180 surrounding the detent or activator member 152. These detents 154 can be seen in FIG. 3 when the detents 154 are displaced upwardly.

The detent member 152 has an enlarged upper U shaped member or portion 158. Extending from the U shaped portion is a round flange or lip 159 having an undercut 190 which rests against a ledge 161 on the top of a cam rod 164. The upper U shaped portion 158 has an inward sloping circular or conical ledge 160. The sloping ledge 160 of the U shaped portion of the spring like detent member 152 permits a camming and lifting action by the cam rod 164 to move in the direction of arrow D of FIGS. 2 and 3, and lift it.

The cam rod 164 has an inclined or sloping cam surface 166 which tends to engage the sloping ledge 160. The cam rod 164 with its sloping cam surface 166 when driven in the direction of arrow D lifts the detent member 152 upwardly in the direction of the arrows as seen in FIG. 3. This causes the detent or prongs 154 of the detent member 152 to engage the inner ledge or circular flange 156. The ledge 156 is engaged by the collapse of the detent member 152 moving inwardly through the quadrant slits 460 through 466. Two of the slits, can be seen in the cross section of FIGS. 2 and 3 that allow for the inward displacement of the detent member 152 so that the detents or prongs 154 with their ridge or angular flange 178 override and then engage the ledge 156 when moved upwardly.

The entire mechanism of the detent member 152 is formed from a single molded plastic member and is axially biased by a coil spring 170. The coil spring 170 is a spring which also provides for the operational functions of the maintenance of the diaphragm assembly 124 against the lever 114. Thus, when the cam rod 164 is driven to the left as seen in FIG. 3 it lifts the detent member 152 upwardly as well as the diaphragm assembly 124, the nut 150, and the U shaped portion 158 connected to the detent member 152. This is of course accomplished by the engaging inclined surface or cam surface 166 engaging the sloping surface or sloping ledge 160 of the detent member 152.

The upward movement of the detent member 152 lifts the nut 150 and the diaphragm against a ledge 180 of the detent member 152 which engages a shoulder 182 of the nut.

The cam rod 164 is sealed by means of an O-ring 184 and is driven and spring biased by a coil spring 186. In order to provide for reference ambient conditions to the diaphragm assembly 124, through holes 187 are provided so that ambient air pressure can be received through the clearance between button 46 and the cover 14.

The coil spring 186 allows the cam rod 164 to be displaced normally toward the right or in the opposite direction to arrow D. When driving the cam rod 164 in the direction of arrow D, it lifts the detent member 152 and engages it such that the detent or prongs 154 engaging the ledge 156 create a holding force of a nominal nature lifting the diaphragm 124 away from operative movement with the pilot valve lever 114. This then stops the pilot valve from functioning to create a flow of gas. In effect the pilot valve 110 is closed and will not cause the main valve 82 to lift off the surfaces 88 to curtail the flow of air through the main valve to the outlet conduit or connector 16.

When the elastomeric manual override button 46 is depressed, it presses downwardly on the detent member 152 via the post 140 and nut 150. This displaces the detent or prongs 154 over the sloping surface or angular flange 156 by pressing it downwardly and radially inwardly. In operation the four split quadrants 468 through 474 of the detent member 152 are radially pressed or flexed inwardly along their slits 460 through 466 causing the detents or prongs 154 to ride over sloping surface or flange 156. At this point, the diaphragm 124 is then in an operative mode to continue functioning for demand regulation of breathing gas.

A substantially important feature of this invention is the ability of a user to place the regulator into an operative mode by inhaling through the conduit or connector 16, when the diaphragm 124 is in an inoperative or overridden lift off position. The inhalation actuation by drawing a vacuum through the conduit or connector 16 causes a pressure to be seen at the diaphragm 124. This causes it to be drawn downwardly opposite from the direction of the arrows in FIG. 3. This overcomes the outward radial force of the detents 154 on their overriding basis against the ledge or circular flange 156 so that it draws downwardly and causes the sloping surfaces engaging each other to slide past each other. This places the diaphragm 124 in its operative position for continued breathing. At this point the diaphragm 124 then becomes operatively able to move the lever 114 to cause the pilot valve 110 to operate the main valve 82.

In effect, the cam rod 164 allows for displacement of the diaphragm 124 when it is moved in the direction of arrow D. This lateral movement or radially inward movement of the cam rod 164 provides for an upward lifting of the detent member 152 thereby lifting off the diaphragm 124 from its operative connection to the lever 114. The detent member 152 is displaced with the detents 154 engaging the ledge or flange 156. Thereafter, when operational breathing is required, inhalation against the diaphragm 124 draws it downwardly to overcome the detent member's 152 engagement of its detents 154 against the sloping ledge or flange 156.

As a consequence, this invention is a significant step over the art by allowing the switching off or override of the regulator by the cam rod 164. It also turns the regulator on or places it into an operative mode through replacement from the displaced position of the diaphragm 124 by downward movement of the elastomeric button 46. As a consequence, this invention is believed to be a significant step over the art in allowing for an operative switching off or override and switching on of a diaphragmatically operated second stage or pressure demand regulator through inhalation against the diaphragm 124 or pushing of button 46 to re-actuate the overridden regulator functions.

Figure 5:
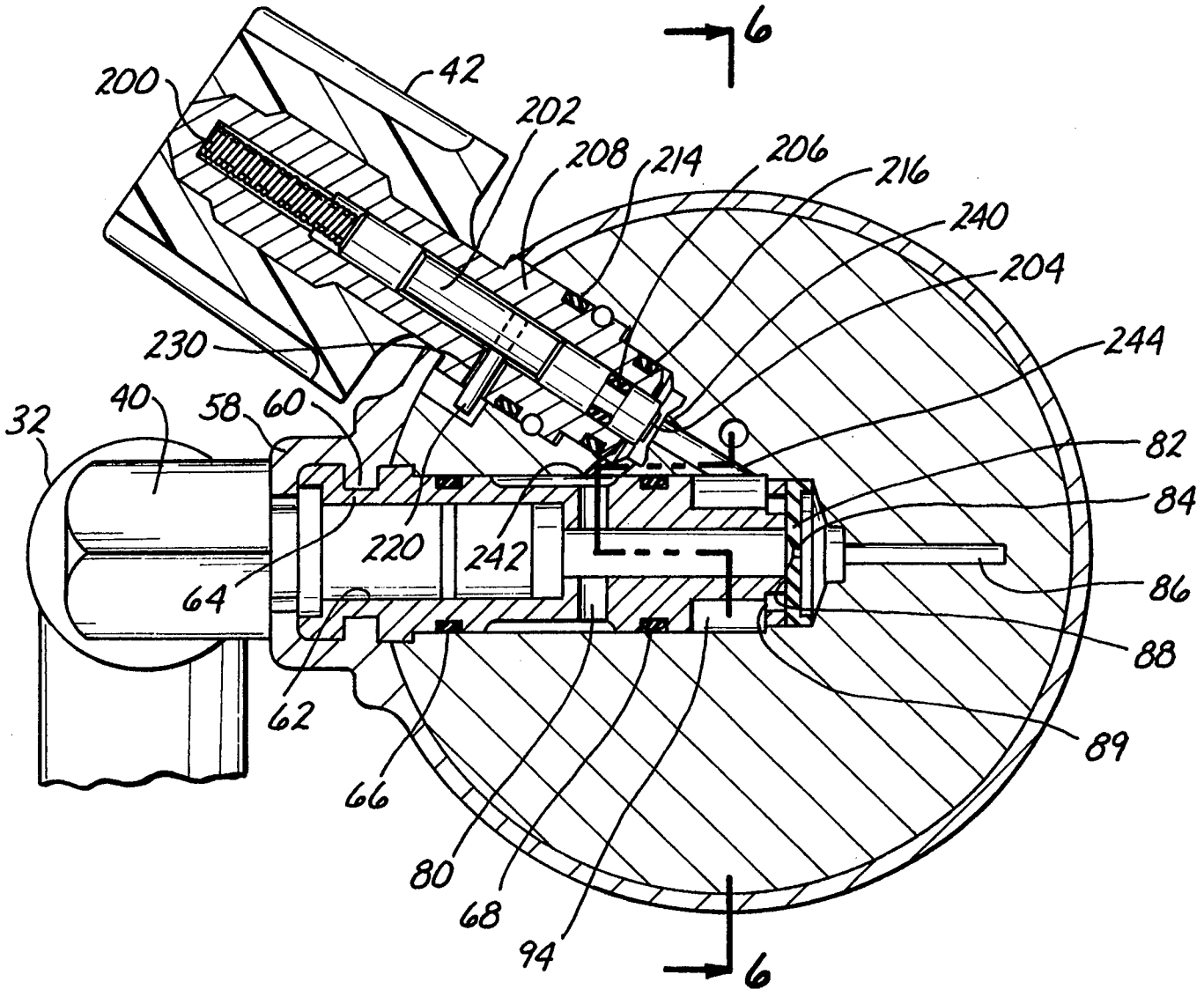
FIG. 5 shows a sectional view taken along lines 5—5 of FIG. 4.

In order to provide for a bypass of the regulator function, a direct flow valve can be controlled by turning a handle or bypass knob 42 as depicted in FIG. 5. Knob 42 receives a coil spring 200 therein. The coil spring 200 serves to drive an assembly shaft 202 with a seal or valve 204 bonded to the end thereof.

The assembly shaft 202 is provided with an O-ring 206 that allows the shaft 202 to be sealed within a handle portion or extension 208 of the handle or knob 42. This extension 208 is sealed within the body 12 of the regulator by means of an O-ring 214, and a second O-ring 216.

A shaft 220 in the form of a pin is seated within the axial shaft assembly 202. This pin 220 is seated axially within the shaft 202. The surface on either side of the pin 220 is provided with an opening in the side of the extension 208 namely opening 230. This opening 230 is cammed around the circumference thereof of the extension 208. As the extension 208 turns, it drives the pin 220 against a cam surface in opening 230 so that the spring force of spring 200 is overcome to lift the seal of valve 204 from off of a valve seat 240. This allows for a flow of gas directly through the passages 80 to an opening 242 in connected relationship to a passage 244 through the valve seat 240.

The flow of gas can take place from the passage 80 directly through an opening 242 connected to an outlet passage 244. The outlet 244 connects to the outlet 94 which then flows to the conduit or connector 16 to a users mask. Thus, a bypass of the regulator is effectuated to supplement the valve 82 function and the pilot valve 110 driving it as well as the regulator diaphragm 124. This provides for a direct gas flow when either the regulator valving system does not function or a user desires a direct flow of gas for either purging, or providing greater flow of breathing gas in the mask.

From the foregoing, it can be seen that this invention can operate with a bypass, a pilot operated regulator function controlling the main valve function as well as a means of lifting the diaphragm from its operative function with the pilot valve to avoid diaphragmatic operation through a cam rod. This elimination of the diaphragmatic operation or override can then be reactuated and placed in an operative mode by inhaling or the driving of a button. All of the override elements are on the side of the diaphragm 124 opposite from the pressure sensing chamber, causing them to be readily accessible, and not interfering with the valving functions within and in association with the pressure sensing chamber. It is believed that this invention is novel over the art due to the lateral cam rod function, the sliding mechanism, and the overall configuration hereof which makes it a significant step over the prior art. For these reasons, the following claims should be read broadly in light of their overall language as to the scope and meaning thereof.

I claim:

1. A pressure demand regulator comprising:

a housing;

means for delivering breathing gas to said housing;

a diaphragm mounted in said housing;

an outlet conduit connected to said housing and adapted for attachment to a means for providing breathing gas to a user;

a passage connected between said outlet conduit and said diaphragm so that said diaphragm can be in fluidically connected relationship to said outlet conduit;

valve means interconnecting said breathing gas delivery means to said outlet conduit for valving breathing gas to said outlet conduit;

cam means attached to said diaphragm for lifting said diaphragm into an inoperative mode, said cam means having a sloping cam surface;

detent means attached to said cam means having a detent thereon and a protuberance for engagement by said detent; and, a cam rod for engaging said cam means sloping cam surface to lift said detent means into a position or placing said detent means in displaced relationship from where said diaphragm is in an operative mode.

2. The pressure demand regulator as claimed in claim 1 further comprising:

spring biasing means for biasing said cam rod into a position of disengagement from said sloping cam surface.

3. The pressure demand regulator as claimed in claim 1 wherein said detent and cam means comprise:

an upstanding member connected to said diaphragm having a U shape with sloping walls forming said sloping cam surface formed as a cam surface for engaging said cam rod, with at least one said detent extending from the side thereof.

4. The pressure demand regulator as claimed in claim 3 further comprising:

spring biasing means for biasing said diaphragm away from engagement with said detent means, said spring means capable of being overcome by said cam rod lifting said U shaped sloping surface; and, wherein said detent means are of sufficient strength to retain said diaphragm against movement by said spring biasing means.

5. The pressure demand regulator as claimed in claim 4 further comprising:

button means overlying said upstanding member for pushing said detent means from engagement to disengagement.

6. The pressure demand regulator as claimed in claim 1 further comprising:

a pilot valve formed with a pilot valve seat and a pilot valve seal connected to a lever, said lever distally therefrom in contacting engagement with said diaphragm; and, means for biasing said lever with said pilot valve into closure until said diaphragm moves said lever with said pilot valve.

7. The pressure demand regulator as claimed in claim 6 wherein:

said pilot valve lever having a pivot point around which said lever moves and is biased by a coil spring.

8. The pressure demand regulator as claimed in claim 7 wherein:

said main valve is an elastomeric member for sealing on a seat surface, that when opened allows for the flow of gas to said outlet conduit.

9. The pressure demand regulator as claimed in claim 8 further comprising:

a bypass conduit between said means for delivering said breathing gas in said regulator that is valved by a movable valve in order to connect said breathing gas directly to said outlet conduit.

10. In a pressure demand regulator having means for delivering breathing gas to a housing and an exit conduit connected to said means for delivering gas to said housing with valve means interconnecting said gas delivery means to said exit conduit and a spring biased diaphragm in fluid connected relationship to said exit conduit operatively connected to said valve means for providing valving of breathing gas therethrough to said exit conduit the improvement comprising:

connector means connected to said diaphragm having detent means thereon and a sloping surface;

a cam means for radially engaging said sloping surface of said connector means for lifting said detent means connected to said diaphragm into a detent engagement with a protuberance in said housing so that when said detent means is lifted by said cam means, it disconnects said diaphragm from said valve means.

11. The improved regulator as claimed in claim 10 wherein:

said connector means is formed from a single molded piece having detents formed from segments thereof that have been divided by slits through which said segments can flex to provide a detent action.

12. The improved regulator as claimed in claim 10 wherein:

said connector means and said cam means are mounted in said housing on the side of said diaphragm opposite from the side of said diaphragm which is in fluid connected relationship to said exit conduit.

13. The improved regulator as claimed in claim 10 wherein:

said cam means comprises a member that moves laterally with respect to said connector and is biased by a spring means.

14. The improved regulator as claimed in claim 13 wherein:

said connector means further comprises a structure having at least one detent extending therefrom for engagement of said protuberance within said housing and an upper portion having an expanded portion forming said sloping surface.

15. The improved regulator as claimed in claim 14 wherein:

said connector further comprises a U shaped upper portion and at least one radially extending detent therefrom for engaging a ledge forming said protuberance in said housing.

16. The improved regulator as claimed in claim 15 further comprising:

a cam means formed with a cam rod which has an opening therein with a cam surface which engages said connector means on its sloping surface to provide a lift thereto when said cam rod is displaced laterally with respect to said connector; and, spring biasing means for biasing said cam rod cam surface away from engagement with said connector.

17. The improved regulator of claim 15 wherein said valve means comprise:

a main valve portion formed from an elastomeric member which forms said valve and seats against a valve surface; and, a lever operated pilot valve having a valve surface overlying a pilot valve seat and with a portion of said lever for engaging contact with said diaphragm so that when said diaphragm is moved, it causes movement of said lever.

18. The improved regulator as claimed in claim 17 wherein:

said lever operating said pilot valve is pivoted around a pivot point and is biased by a spring for biasing said lever with said pilot valve into a closure with said pilot valve seat and into contact with said diaphragm.

19. A method for providing pressure demand regulated breathing gas to a user and overriding said pressure demand regulation when desired comprising:

providing a housing having a breathing gas connection and an exit conduit in a fluid connected relationship to said breathing gas connection;

providing a main valve interposed between said breathing gas connection and said exit conduit;

causing said main valve to be relieved from its valve surfaces by creating a differential pressure across said valve through a pilot valve;

providing a connection between said pilot valve and a diaphragm;

biasing said diaphragm against said pilot valve connection;

providing a cam surface with a detent connected thereto and a protuberance within said housing for said detent to engage;

laterally moving a cam against said cam surface while moving said detent into engagement with said protuberance to limit the bias of said diaphragm against said pilot valve connector;

providing means for connecting said diaphragm to said exit conduit in a fluid connected relationship; and, overcoming said detent engagement of said protuberance by inhalation moving said diaphragm while withdrawing said detent means from the protuberance within said housing for continued operation of said regulator.

20. The method of regulation as claimed in claim 19 further comprising:

spring biasing said laterally moving cam from engagement with said cam surface.

21. The method as claimed in claim 20 further comprising:

providing button means for displacing said detent over said protuberance in said housing.

22. The method as claimed in claim 21 further comprising:

balancing said pilot valve by connecting said pilot valve to a spring biased lever forming said diaphragm connection means; and, pivoting said lever around a pivot point in spring biased relationship.

23. The method as claimed in claim 22 further comprising:

providing a main valve with an elastomeric cross section having an orifice therethrough in connected relationship to said pilot valve; and, causing said main valve to be imbalanced by said pilot valve when said pilot valve opens over its pilot valve seat.

* * * * *